United States Patent [19]

Paulet et al.

[11] Patent Number: 4,728,398

[45] Date of Patent: Mar. 1, 1988

[54] ELECTROPLATING BATH FOR SIMULTANEOUS DEPOSITION OF METAL AND A PERMANENT SOLID LUBRICANT

[75] Inventors: Jean-François Paulet, Siblingen; Jean-Claude Puippe, Wallisellen, both of Switzerland; Heinz Steup, Donaueschingen, Fed. Rep. of Germany

[73] Assignee: Werner Flühmann AG, Dübendorf, Switzerland

[21] Appl. No.: 4,472

[22] PCT Filed: Apr. 18, 1986

[86] PCT No.: PCT/CH86/00052

§ 371 Date: Dec. 12, 1986

§ 102(e) Date: Dec. 12, 1986

[87] PCT Pub. No.: WO86/06419

PCT Pub. Date: Nov. 6, 1986

[30] Foreign Application Priority Data

Apr. 22, 1985 [CH] Switzerland ..... 1718/85

[51] Int. Cl.[4] ..... C25D 5/02

[52] U.S. Cl. ..... 204/16; 204/48; 204/49; 204/44.5; 204/44.7; 204/DIG. 2

[58] Field of Search ..... 204/48–49, 204/44.5, 44.7, 16, DIG. 2

[56] References Cited

U.S. PATENT DOCUMENTS

| | | | |
|---|---|---|---|
| 3,677,907 | 7/1972 | Brown et al. | 204/16 |
| 3,981,781 | 9/1976 | Mori et al. | 204/16 |
| 4,160,707 | 7/1979 | Helle et al. | 204/37 R |
| 4,222,828 | 9/1980 | Zuurdeeg | 204/16 |
| 4,302,322 | 11/1981 | Oda et al. | 204/16 |
| 4,315,912 | 2/1982 | Kalopissis | 424/70 |
| 4,627,896 | 12/1986 | Nazmy et al. | 204/16 |

FOREIGN PATENT DOCUMENTS

| | | | |
|---|---|---|---|
| 2712730 | 11/1977 | Fed. Rep. of Germany | 204/16 |
| 2470595 | 6/1981 | France | 204/16 |
| 623851 | 4/1976 | Switzerland | 204/16 |
| 1366823 | 9/1974 | United Kingdom | 204/16 |

*Primary Examiner*—R. L. Andrews

*Attorney, Agent, or Firm*—Bachman & LaPointe

[57] ABSTRACT

The disadvantages of difficulty in operation of the bath and unfavorable physical properties obtained with the simultaneous deposition of metal and a permanent solid lubricant in electroplating baths of conventional composition and containing solid lubricant particles and a perfluorized compound acting as a cationic tenside are avoided if, instead of the perfluorized compound, the bath contains where $A_1$–$A_9$ is H or an alkyl radical with low C number, $R_1$–$R_9$ is H, OH or an alkyl radical with low C number, X is a halogen or $SO_4$ and n is the valency of X. Preferred solid lubricants are polytetrafluoroethylene, graphite, graphite fluoride or molybdenumdisulfide.

10 Claims, 2 Drawing Figures

ELECTROPLATING BATH FOR SIMULTANEOUS DEPOSITION OF METAL AND A PERMANENT SOLID LUBRICANT

BACKGROUND OF THE INVENTION

The invention relates to an electroplating bath of conventional composition containing solid lubricants particles and a water soluble, surface active agent which, at the pH of the specific electroplating solution, exhibits cation properties, for simultaneous deposition of metal and a permanent solid lubricant.

An electroplating bath i.e. solution of this kind is known from the German patent publication DE-AS No. 21 64 050. Surface active agents proposed there are compounds which incorporate fluorine-carbon bonds in the molecule i.e. perfluorised compounds. Several patents (e.g. CH-PS No. 623 851, GB-PS No. 1 366 823, U.S. Pat. No. 3,677,907) are known in connection with the precipitation of nickel-polytetrafluorethylene dispersion layers in which patents perfluorised compounds are also employed as cationic tensides.

The above mentioned baths suffer the disadvantage that perfluorised compounds can be employed only in narrow concentration range and have only little effect. Furthermore, the product concentrations must be maintained very accurately, which adds difficulty to the use of such baths. Also, the precipitated products frequently exhibit pores, galling and undesireable surface roughness. Such layers exhibit a higher degree of brittleness and so often tend to spall, which limits the use of such electroplated, metallic layers.

The object of the invention is therefore to prepare an electroplating bath of the kind mentioned at the start which does not or at least to some extent does not exhibit the above mentioned disadvantages.

SUMMARY OF THE INVENTION

This object is achieved by way of the invention in that the electroplating bath contains a cation type surfactant of the type

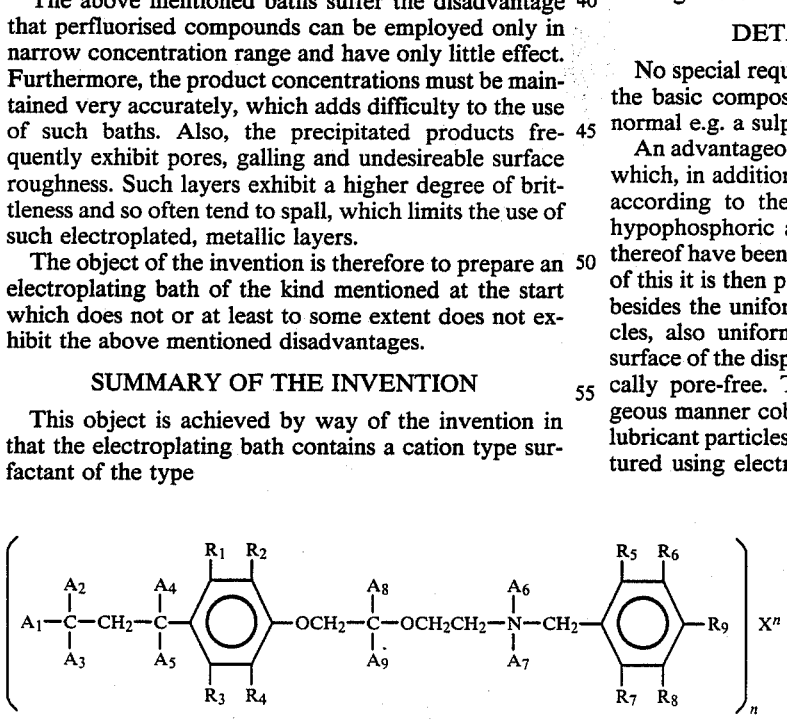

where $A_1$–$A_9$ is H or an alkyl radical with a low C number, $R_1$–$R_9$ is H, OH or an alkyl radical with low C number, X is a halogen or $SO_4$ and n is the valency of X.

Substances which have been shown to be advantageous are those in which $A_1$–$A_7$ is $CH_3$ and $A_8$, $A_9$ and $R_1$–$R_9$ are H:

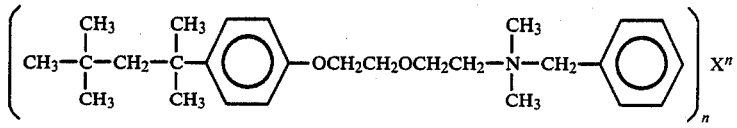

Also, substances of the following kind have been found to be particularly advantageous:

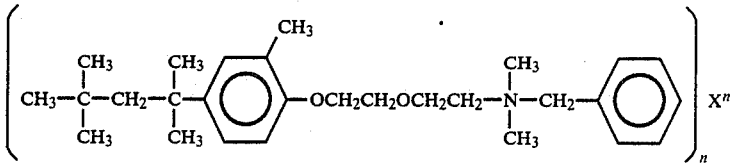

These substances differ from the foregoing only in that $R_2$ contains a $CH_3$ group instead of H. In both of the last mentioned types of compounds the bromides and chlorides have shown themselves to be particularly advantageous halides.

It should be mentioned that it makes practically no difference whether the above mentioned compounds or their monohydrates are employed as the cationic surfactant.

DETAILED DESCRIPTION

Figure 1:
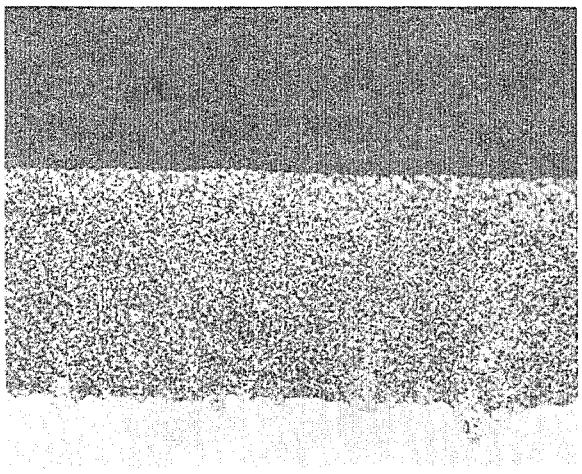
FIG. 1 is a micrograph showing a cross section of the coating made in accord with Example 1.

No special requirements are specified with respect to the basic composition of the electroplating bath. The normal e.g. a sulphamate or Watts bath.

An advantageous effect has been found using baths to which, in addition to the cationic surfactant compound according to the invention, phosphoric acid and/or hypophosphoric acids and/or at least one of the salts thereof have been added to the bath solution. As a result of this it is then possible to achieve in the metal matrix, besides the uniform deposition of solid lubricant particles, also uniform incorporation of phosphorus. The surface of the dispersion type coating obtained is practically pore-free. Thus, and in a particularly advantageous manner cobalt-nickel-phosphor layers with solid lubricant particles incorporated therein can be manufactured using electroplating baths containing nickel and cobalt to which phosphoric acid and/or hypophosphoric acid and/or at least one of the salts thereof have been added in addition to the cationic surfactant compounds according to the invention.

Preferred permanent solid lubricating agents are polyfluorcarbon resins, in particular polytetrafluorethylene, graphite graphite fluoride and molybdenumdisulphide. In order to ensure an adequate amount of solid lubricant is incorporated in the layer, the average particle size of the lubricant should not exceed 10 μm. The best results were achieved with particulate sizes of 3–6 μm.

With baths according to the invention in which chlorides in particular were employed as the surfactant practically none of the above mentioned disadvantages could be observed.

Furthermore, the layers produced in baths according to the invention exhibited advantageous mechanical properties. Thus the elongation lay far above the normal value of about 0.3% and the internal stresses far below 150 N/mm$^2$. The lubricating properties and the wear resistance using polytetrafluorethylene, graphite, graphite fluoride and molybdenumdisulphide as permanent solid lubricant were indeed of high quality and in each case reproducible.

This was not always found to be so when using state-of-the-art electroplating baths for the same purpose. The structures of the coatings showed no flawed regions. The amout of particles incorporated in the layer was constant the whole time, in some cases however only after a short interval at the start of the process.

Further advantages, characteristics and details of the invention are explained in the following with the aid of examples which gave particularly good results. As such, typical electroplating baths such as for example sulphamate or sulphate baths have been taken as the starting point. The surfactant substance chosen was either:

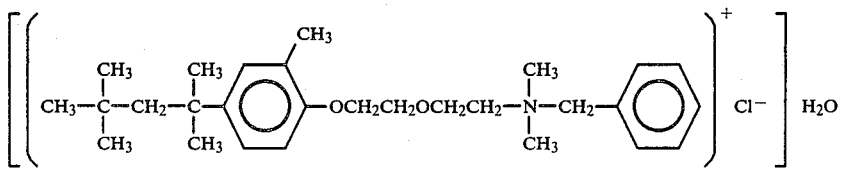

(di-isobutyl-cresoxy-ethoxy-ethyldimethylbenzyl-ammoniumchloride-monohydrate) which is available commercially as Hyamin 10-X and for brevity is designated as such in the examples, or

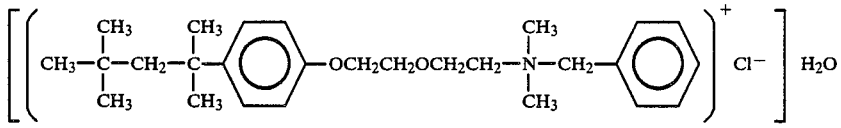

di-isobutyl-phenoxy-ethoxy-ethyldimethylbenzyl-ammoniumchloride-monohydrate) which is available commercially as Hyamin 1622 and is therefore designated as such in the examples in the interest of brevity.

EXAMPLE NO. 1

An electroplating bath of the following constituents was prepared:

Nickel sulfamate $Ni(NH_2SO_3)_2$: 300 g/l
Nickel chloride $NiCl_2.6H_2O$: 18 g/l
Boric acid $H_3BO_3$: 25 g/l
Non-ionic wetting agent: 3 ml/l
Cationic surfactant: Hyamin 10-X:
Solid lubricant: polytetrafluorethylene (PTFE): 20 g/l
pH value: 4

The dispersion of polytetrafluorethylene contained 60% solid particulate, the size of which particulate lay between 0.2 and 3 μm. The addition of the dispersion to the electrolyte was made slowly and was accompanied by vigorous stirring. The Hyamin 10-X was dissolved separately in warm water and then added progressively to the electrolyte. On employing an electrolyte temperature of 50° C. and a current density of 4 A/dm$^2$ the following amounts of polytetrafluorethylene (herinafter denoted as PTFE) were incorporated as a function of the Hyamin content, on deposition of the dispersion layer on an aluminum sheet:

| Hyamin content mg/g PTFE | Amount of PTFE incorporated Vol. % |
|---|---|
| 0 | 0 |
| 5 | 9 |
| 10 | 19 |
| 15 | 23 |
| 20 | 26.5 |
| 25 | 28.5 |
| 30 | 31 |
| 35 | 33.5 |
| 40 | 36 |

By increasing the PTFE concentration and the current density the amount of PTFE that could be incorporated in the layer was increased to over 50 vol. % e.g. at:

PTFE concentration: 50 g/l
Hyamin 10-X concentration: 25 mg/g PTFE
Current density: 10 A/dm$^2$ Amount incorporated: 51.3%

FIG. 1 is a micrograph of such a dispersion showing a cross section through the coating. The bright spots are the nickel particles and the dark spots the PTFE particles. It can be seen that the amount of solid lubricant deposited in the layer was constant throughout the whole of the deposition process.

EXAMPLE NO. 2

An electroplating bath was prepared using the following constituents:

Nickel sulfamate $Ni(NH_2SO_3)_2$: 600 g/l
Cobalt chloride $CoCl_2.6H_2O$: 30 g/l Boric acid $HBO_3$: 40 g/l
Non-ionic wetting agent: 3 ml/l
Cationic surfactant: Hyamin 1622: 30 mg/g PTFE
Solid lubricant: molybdenumdisulfide $MoS_2$ (particle size 4–6 μm): 20 g/l
pH value: 4

In a manner analogous to the first example a dispersion coating was deposited at a temperature of 50° C. and using a current density of 5 A/dm$^2$; the metal matrix of the said coating was made up of 65% Ni and 35% Co. The amount of $MoS_2$ incorporated in the layer was 14 vol. %.

EXAMPLE NO. 3

An electroplating bath of the following constituents was prepared:

Cobalt sulfate $CoSO_4.7H_2O$: 252 g/l
Cobalt chloride $CoCl_2.6H_2O$: 15 g/l
Boric acid: 25 g/l
Non ionic wetting agent: 3 ml/l
Cationic surfactant: Hyamin 10-X: 0–25 mg/g graphite
Solid lubricant: Graphite (average particle size 3 μm): 25 g/l
pH value: 4

In a manner analogous to that in the first example dispersion coatings were prepared using different concentrations of cationic surfactant, a temperature of 50° C. and a current density of 4 A/dm$^2$. The following results were obtained:

| Hyamin content mg/g graphite | Amount graphite incorporated Vol. % |
|---|---|
| 0 | 0 |
| 2.5 | 0.5 |
| 5 | 0.5 |
| 10 | 1.2 |
| 15 | 4.5 |
| 20 | 5.2 |
| 25 | 6.7 |

EXAMPLE NO. 4

An electroplating bath was prepared from the following constituents:

Cobalt sulphate $CoSO_4.7H_2O$: 252 g/l
Cobalt chloride $CoCl_2.6H_2O$: 15 g/l
Boric acid $HBO_3$: 25 g/l
Non-ionic wetting agent: 3 ml/l
Cationic surfactant: Hyamin 10-X: 25 mg/g $CF_x$
Solid lubricant: graphite fluoride $CF_x$ (average particle size 6 μm): 30 g/l
pH value 4

The base composition of the bath is the same as that in example No. 3. The graphite fluoride used had a fluorine to graphite ratio of 0.9, a density of 2.6 and a true surface area of 200–340 m$^2$/g.

Figure 2:
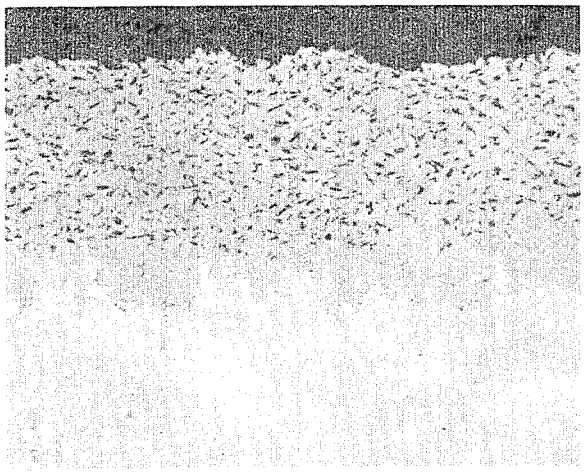
FIG. 2 is a micrograph showing a cross section of the coating made in accord with Example 4.

A dispersion coating was deposited as in the previous example at a temperature of 50° C. and a current density of 8 A/dm$^2$. FIG. 2 is a micrograph of the coating—taken under the same conditions as FIG. 1. After a short interval during which only metal was deposited, the graphite fluoride (dark particles) were uniformly incorporated in the layer. The amount of solid lubricant amounted to 11 vol. % of the layer.

The layer exhibited the following properties:
Internal (tensile) stress: 80 N/mm$^2$
Elongation: 1.5%
Microhardness: 300 Hv
Coefficient of friction: 0.14

The tribological measurements were made via the Pin-disc method under the following conditions: Hardened steel ball, 5 mm in diameter; 50 revolutions/minute; load 4N; temperature 20° C.; rel. humidity approx. 50%; duration of test 24 h.

EXAMPLE NO. 5

An electroplating bath was prepared as for example No. 2 but with the further addition of 100 ml/l 30 wt% phosphoric acid and containing, as the sole solid particulate lubricant, 30 g/l of graphite fluoride $CF_x$ (average particle size 6 μm). The pH value of the bath was 2.5.

Again, analogous to example No. 1, a dispersion coating was deposited at a temperature of 50° C. and current density of 5 A/dm$^2$, the matrix of which coating contained phosphor as well as nickel and cobalt. The deposited nickel-cobalt-phosphorus layer, in which the $CF_x$ particles were uniformly distributed, was amorphous.

EXAMPLE NO. 6

In a manner analogous to example No. 5 a bath of composition as in example No. 2 was prepared, however instead of phosphoric acid contained an addition of 35 g/l of sodium hypophosphite and, as sole solid particulate lubricant, 30 g/l of molybdenum disulfide (particle size 4–6 μm). The pH value of the bath was 3.

The conditions for deposition of the dispersion coating were identical to these in example No. 1. A dense cobalt-nickel-phosphorus matrix in an amorphous state was obtained as in example 5, in this case containing $MoS_2$-particles uniformly distributed throughout.

Further trials performed were concerned with the combined use of phosphoric acid, hypophosphoric acids, phosphite(s) and/or hypophosphite(s) in baths containing nickel and cobalt. Furthermore, the various solid lubricant materials were added as mixtures to the baths. From these it was found that in none of the trials was the amount of solid lubricant mixtures negatively affected, and the combined use of the aforementioned additives had no negative effect on the dispersion coating. In fact rather the opposite was the case as, in some trials employing baths containing not only phosphoric acid but also hypophosphite(s) and/or phosphite(s) and/or hypophosphoric acid, smoother dispersion coating surfaces were obtained than when only one of the above mentioned compounds was present.

What is claimed is:

1. An aqueous electroplating bath containing solid lubricant particles and a water soluble surfactant which, at the pH of the electroplating bath, exhibits cationic properties, for simultaneous deposition of at least one metal and a permanently lubricating solid lubricant, in which, the water-soluble, cationic surfactant is a compound consisting essentially of

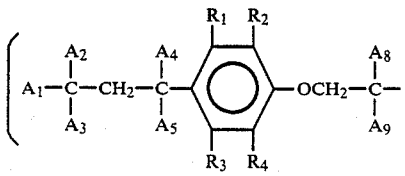

-continued

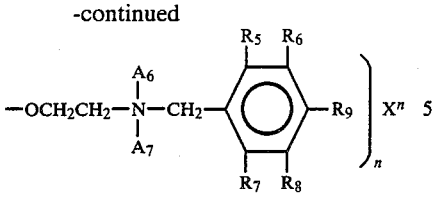

where $A_1$–$A_9$ is H or an alkyl radical, $R_1$–$R_9$ is H, OH or an alkyl radical, X is a halogen or $SO_4$ and n is the valency of X.

2. Electroplating bath according to claim 1, in which the water-soluble, cationic surfactant is a compound consisting essentially of

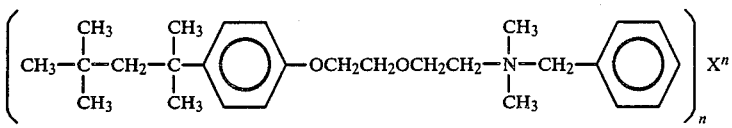

3. Electroplating bath according to claim 1, in which the water soluble, cationic surfactant is a compound consisting essentially of

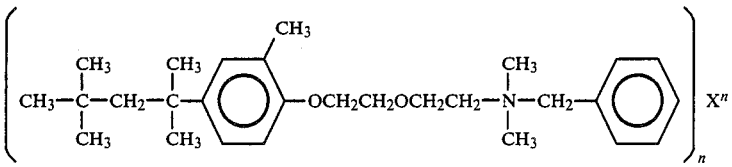

4. Electroplating bath according to claim 1, in which X is Br.

5. Electroplating bath according to claim 1, in which X is Cl.

6. Electroplating bath according to claim 1, in which the solid lubricant is selected from the group consisting of polytetrafluorethylene, graphite, graphite fluoride and molybdenumdisulfide.

7. Electroplating bath according to claim 6, in which the solid lubricant particles are 3–6 μm in size.

8. Electroplating bath according to claim 1, in which the bath additionally contains at least one of phosphoric acid and a salt of phosphoric acid.

9. Electroplating bath according to claim 1, in which the bath additionally contains at least one of hypophosphoric acid and a salt of hypophosphoric acid.

10. Electroplating bath according to claim 1, wherein said bath is used to manufacture cobalt-nickel-phosphorus coatings having solid lubricant particles incorporated therein.

* * * * *